US006733311B2

(12) United States Patent
Kameda

(10) Patent No.: US 6,733,311 B2
(45) Date of Patent: May 11, 2004

(54) CONNECTOR WITH SHUTTER

(75) Inventor: Yasutoshi Kameda, Ichihara (JP)

(73) Assignee: FCI 53, Paris (FR)

( * ) Notice: Subject to any disclaimer, the term of this patent is extended or adjusted under 35 U.S.C. 154(b) by 0 days.

(21) Appl. No.: 10/308,601

(22) Filed: Dec. 3, 2002

(65) Prior Publication Data

US 2003/0119348 A1 Jun. 26, 2003

(30) Foreign Application Priority Data

Dec. 4, 2001 (JP) ..... 2001-369701

(51) Int. Cl.[7] ..... H01R 13/141
(52) U.S. Cl. ..... 439/140; 439/141
(58) Field of Search ..... 439/140, 141, 439/139, 260, 638; 301/684, 686, 672

(56) References Cited

U.S. PATENT DOCUMENTS 6,109,940 A * 8/2000 Chad et al.

6,203,378 B1 * 3/2001 Shobara et al. ..... 439/638

OTHER PUBLICATIONS

Japanese Patent No. 2999364.
Japanese Patent Application Publication No. H1–161683.
Japanese Utility Model Publication No. S63–186067.
Japanese Utility Model Publication No. S63–188879.
Japanese Utility Model Publication No. H5–6726.

* cited by examiner

*Primary Examiner*—Alex Gilman
(74) *Attorney, Agent, or Firm*—Perman & Green, LLP

(57) ABSTRACT

A connector with a shutter for protecting a contact portion of a peripheral device used in a computer, said connector comprising a housing, a shutter capable of closing an aperture portion of the housing, a spring for applying pressure to said shutter in the closed position and a stopper for detaining said shutter in the closed position, said housing accommodating said shutter, spring and stopper, and said shutter comprising a guiding device for guiding said shutter when said shutter slides in opposition to the pressure of said spring.

5 Claims, 4 Drawing Sheets

CONNECTOR WITH SHUTTER

TECHNICAL FIELD OF THE INVENTION

The present invention is a connector with a shutter for use with a peripheral device or the like for a computer, and is specifically a connector with a shutter for preventing damage to electronic circuits inside the peripheral device due to static electricity or the like, caused by the hand contacting the contact portion while carrying the peripheral device.

Conventional Art

In peripheral devices for connection to computers, the connector portions of the peripheral devices are often exposed to the outside. Among high-capacity memory devices which are a type of peripheral device, examples include hard disk drives (hereafter referred to as HDD's).

In recent years, the popularity of laptop computers (or so-called notebook computers) has led to smaller HDD's, and the storage of music and video has shifted from recording media using conventional magnetic tape to storage on recording media for computers such as HDD's, thus causing a steady increase in the capacity of HDD's.

Furthermore, the spread of broadband technology and the like on the internet can be predicted to result in increased distribution of music and video through the internet, making it desirable to be able to record such data through portable recording media. Thus, a future increase in the demand for portable high-capacity HDD's can be foreseen.

On the other hand, when using HDD's as recording media for music and video in conjunction with computers, the ease with which copying is possible will give rise to problems of security, but a security chip for maintaining the security of data is currently in development, so that security problems can be solved by mounting such a security chip on the HDD.

Problems to be Solved by the Invention

In this case, the structure of the above-mentioned connector portion of the HDD presents a problem. If the contact in the connector portion of the HDD is exposed to the outside, the connector can come into contact with the hands, in which case static electricity or the like can cause damage to electronic circuits, chips and the like in the HDD. If there is a security chip, the risk of damage due to static electricity or the like is likewise extremely high. In this case, not only does it become impossible to maintain the security of the data, but damage to the HDD control circuitry could make it impossible to read out the recorded data.

Additionally, since it is important to protect the contact portion from dust and the like in order to avoid damaging the hardware, a mechanism for protecting the contact portion is needed. Japanese Patent No. 2999364 proposes, as an "electrical connector", a connector with a shutter. In this connector, a shutter is provided on a male connector, and this shutter slides inside the connector under pressure when the connector is plugged. However, this connector simply closes off the front surface of the connector by pressure from a spring when not plugged, and does not secure the shutter, so that the touch of a hand can easily cause the shutter to move, thereby exposing the contact portion.

Additionally, while Japanese Patent Application, First Publication No. H1-161683 also proposes a "connector with shutter", this connector also does not secure the shutter when not plugged in, which gives rise to the problem of the contact portion being exposed as described above.

Similarly, Japanese Utility Model Publications S63-186067, S63-188879 and H5-6726 all propose connectors having a shutter function, but these shutters are also unsecured, thus involving the same problems as described above.

Additionally, while HDD's have been taken as an example here, the above-described problem is common too all devices having a contact portion outside the body, such as, for example, DVD drives.

Means for Solving the Problems

In view of the above, and with the aim of overcoming the above-described problems, the present invention offers a connector with a shutter for protecting a first contact portion of a peripheral device used in a computer, said connector being characterized by comprising a housing having an aperture into which a second contact portion can be inserted; a shutter capable of closing said aperture; a spring for applying pressure to said shutter in the closed position; and a stopper for detaining said shutter in the closed position; wherein said housing accommodates said shutter, spring and stopper, and said shutter comprises a guiding device for guiding said shutter when said shutter slides in opposition to the pressure of said spring.

EMBODIMENTS OF THE INVENTION

The structures of the respective parts of the present invention shall be described hereafter with reference to the drawings. FIG. 1 is an exploded view of a connector with shutter according to the present invention. In the drawing, the housing 20 comprises an aperture portion 26 into which a second contact portion can be inserted, a first contact portion 25 in the center of the aperture portion 26 and guide devices 24 provided to the right and left of the aperture portion 26. To the right and left outside of the housing are provided guide rails 22 for insertion of stopper release means, with a taper that increases in going from inside to outside being provided at the entrance to the guide rails. The guide rails 22 are provided with aperture portions 27 to enable a portion of the stopper to project inside the rails. Next, springs 23 for pressing the shutter 11 to close the aperture portion 26 are inserted over the cylindrical guide devices 24. An aperture portion 12 through which the first contact portion passes is provided in the shutter, and through holes 15 are opened on both edges of the aperture portion 12 to enable passage of the guide devices 24. Additionally, both sides of the shutter 11 have a first detaining portion 13 for keeping the shutter from being pushed outside the housing by the pressure of the spring when not plugged in, and a second detaining portion 14 for keeping the shutter from being pushed back into the housing by pressure from an external force when not plugged in. Although the shutter is detained by the pressure of the spring and the first detaining portion 13 when not plugged in, it is preferable in this case for the front surface of the shutter to be positioned slightly behind the front surface of the housing, i.e. the surface having the aperture portion 26, in the direction of insertion of the connector. Specifically, it should be positioned about 0.2 mm behind. However, the position of the shutter 11 is not restricted thereto. Additionally, while a plurality of the first detaining portion 13 may be provided, there is no restriction thereto, as described above.

FIG. 2 is a rear perspective view of a connector according to the invention, shown along with a slot 30. The slot 30 is provided with stopper release means 32 which are tapered at the tip, and has opened therein a guide device insertion port 33 for insertion of the guide device 24, and a contact receiving portion 34. Additionally, when plugging in the connector, the face 31 in which the guide device insertion port 33 and the contact receiving portion 34 are provided pushes the shutter 11 to release the detainment, to expose the first contact portion 25.

Next, the structure of the stopper 40 is shown in FIG. 3. As shown in the drawing, it consists of securing portions 44, 42 for securing the stopper to the housing, a shutter detaining portion 43 for detaining the shutter, a detaining portion support 45 and a stopper release portion 41. The stopper release portion 41 projects into the guide rails 22 positioned on both sides of the housing 20. While the details shall be described below, the shutter 11 is released from detainment when the stopper release means 32 presses against the stopper release portion 41 so as to move the shutter detaining portion 43.

The structures of the respective parts of the connector have been described above. Next, the makeup of the connector with shutter of the present invention shall be described. FIG. 4 is a partial cutaway view of the connector. As seen in the drawing, a shutter 11 is provided inside the housing 20 so as to seal off the aperture portion 26 of the housing, and is pressed by a spring 23 installed in the guide device 24. To oppose the pressure from the spring, the shutter 11 is detained against the housing by means of a claw 16 on a first detaining portion 13 (see FIG. 5). The center of the through hole 15 of the guide device of the shutter 11 is aligned with the center axis of the guide device 24 provided in the housing 20. A stopper 40 is provided adjacent to the shutter, and when unplugged, the shutter detaining portion 43 is positioned immediately behind a second shutter detaining portion 14 of the shutter 11. The stopper release portion 41 of the stopper 40 projects through an aperture portion 26 provided in the guide rail 22 to be positioned inside the guide rail 22.

FIG. 5 is a drawing showing the state in which the shutter 11 is detained to the housing 20 by means of the claw 16 on the first detaining portion 13 of the shutter 11 in opposition to the pressure of the spring 23.

As described above, in the connector with shutter of the present invention, the shutter 11 is detained and secured by means of the stopper 40, even when unplugged.

Next, the details of the actions to be taken when plugging in the connector with shutter of the present invention shall be described. With reference to FIGS. 2 and 4, a connector 10 and a slot 30 are brought opposite each other, and the connector 10 is inserted into the slot 30. At this time, stopper release means 32 in the slot 30 are inserted into the connector along guide rails 22. As the connector is slid further inside the slot, the stopper release means 32 contacts a stopper release portion 41 projecting into the guide rail. If the connector 10 is slid still further, the tapers of the stopper release means 32 press the stopper release portion toward the inside of the housing, while a securing portion 44 of the stopper is warped toward the inside of the housing. As a result, the shutter detaining portion 43 also moves from an initial position toward the inside of the housing. If the shutter detaining portion 43 is moved a sufficient distance, the detaining portion 43 is released from immediately behind the second detaining portion 14 of the shutter 11, thus releasing the shutter 11 from detainment.

As the connector slides yet further, the face 31 of the slot 30 comes into contact with the shutter. Since the shutter 11 is already released from detainment at this time, the pressure from sliding the connector will cause the face 31 to slide the shutter 11. At this time, the second detaining portion 14 of the shutter 11 passes through the arch-shaped space formed by the shutter detaining portion 43 of the stopper 40, the detaining portion support 45 (see FIG. 3) and the stopper securing portion 44. As a result, the first connector portion of the connector is able to fit with a second contact portion in the slot.

Next, the actions to be taken to release the connector 10 from the connector receiving portion shall be described. When the connector and slot are fitted together, the stopper 40 is pressed by the stopper release means 32 of the slot and is thereby warped, so that the stopper release portion 41 contacts the stopper release means 32 and applies pressure to the stopper release means 32. The connector slides in this state. Additionally, at this time, the pressure of the spring 23 for pressing the shutter 11 causes the shutter 11 to be pressed outward with respect to the connector housing. When the connector is slid further, before the taper portion of the stopper release means 32 reaches the stopper release portion 41, the second detaining portion 14 of the shutter 11 arrives before the shutter detaining portion 43, i.e. on the housing aperture portion 26 side. Next, the taper portion of the stopper release means reaches the position of the stopper release portion 41, whereupon the stopper release portion 41 moves along the slope of the taper due to the pressure from the warpage of the stopper securing portion 44, until the stopper release portion 41 finally projects into the guide rail 22 to return the stopper to its initial state. At this time, the shutter detaining portion 43 also moves similarly, and comes to a position immediately behind the second detaining portion 14 of the shutter 11. In this state, it becomes possible to detain the shutter 11. By further pulling the connector, the shutter can be pushed further outside the housing by the pressure from the spring 23, so that the first detaining portion 13 of the shutter 11 is detained by the housing 20 at a predetermined position (see FIG. 5), and the movement of the shutter 11 stops.

The manner in which the connector is separated from the slot is has been described above. While the connector of the present invention primarily protects the contact portions of HDD's from contact with the hands as described above, those skilled in the art will recognize that it also has the effect of preventing invasion by dust. Additionally, the present invention is effective not only for HDD's, but also for other peripheral devices for computers, such as printers, DVD drives and the like, having a structure in which contact portions are exposed from the casing.

FIG. 6 is a perspective view of the connector of the present invention, when connected with a so-called flat cable 60. One end of the flat cable is soldered to the back surface of the first contact portion of the connector, i.e. the end portion on the side which connects to the HDD. The other end of the flat cable is connected to the HDD, and the connector, cable and HDD are housed in a casing. At this time, the structure can be made to absorb impacts when dropped or the like, by housing them such that the HDD body is not rigidly affixed to the casing. The dotted chain line in FIG. 6 represents the casing for housing the connector, flat cable and HDD.

Another embodiment of the present invention is shown in FIGS. 7 and 8. In FIG. 7, a concave notch 70 is provided in the second detaining portion 14. Additionally, in FIG. 8, a stopper release means 71 is provided along the slot. As shown in the drawing, the length of the stopper release means 71 is made shorter than the length of insertion of the connector.

As described above, when the connector is inserted into the slot, the stopper release means presses against the stopper release portion 41, thus releasing the detainment of the shutter, and causing the shutter to be pushed and slid away from the face 31 of the slot. When the connector is further slid out, the pressure applied to the stopper 40 by the stopper release means 71 is released at a predetermined position due to the fact that the stopper release means 71 is shorter than the connector insertion length. At this time, the shutter detaining portion 43 of the stopper fits into the notch 70 of the second detaining portion 14. As a result, the shutter is secured, and the first contact portion and second contact portion can be reliably fitted together.

Additionally, in order for the second detaining portion 14 to fit with the shutter detaining portion 43, adequate force is necessary. Therefore, the second detaining portion 14 may be formed as a separate body of a material such as metal for attachment.

The above-described embodiments and drawings are given for the purpose of indicating representative structures for understanding the present invention. Therefore, whereas the shape and structure of the connector and slot, specifically the shape and location of the first and second detaining portions of the shutter, the shape and location of the through holes 15 and guide devices 24 of the shutter and housing (see FIG. 4), the shape and location of the stopper 40 and the shape and location of the stopper release means 32, and other features could be readily modified by those skilled in the art, all of such modifications are to be included within the scope of the present invention.

EFFECTS OF THE INVENTION

As described above, the present invention offers a connector for peripheral devices such as HDD's with security chips or the like, the connector having a shutter to prevent the contact portions of the peripheral devices from being exposed to the outside when not plugged in as when being carried, especially damage to the electronic circuitry inside due to static electricity when touched by the hand, by providing a mechanism for detaining and securing the shutter when unplugged, thus protecting the contact portion.

DESCRIPTION OF REFERENCE NUMBERS

Figure 1:
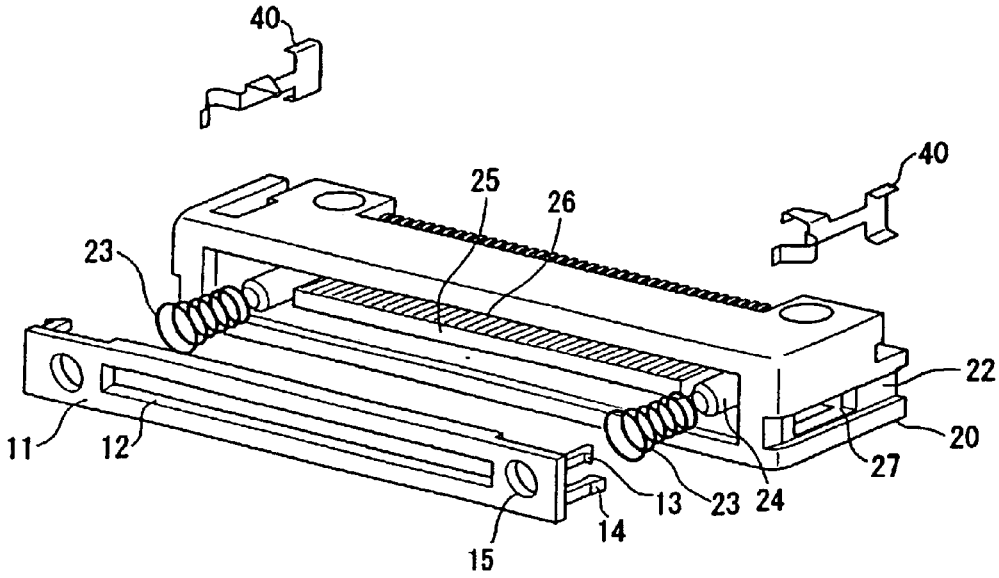
FIG. 1 is an exploded view of a connector with shutter according to the present invention.
Figure 2:
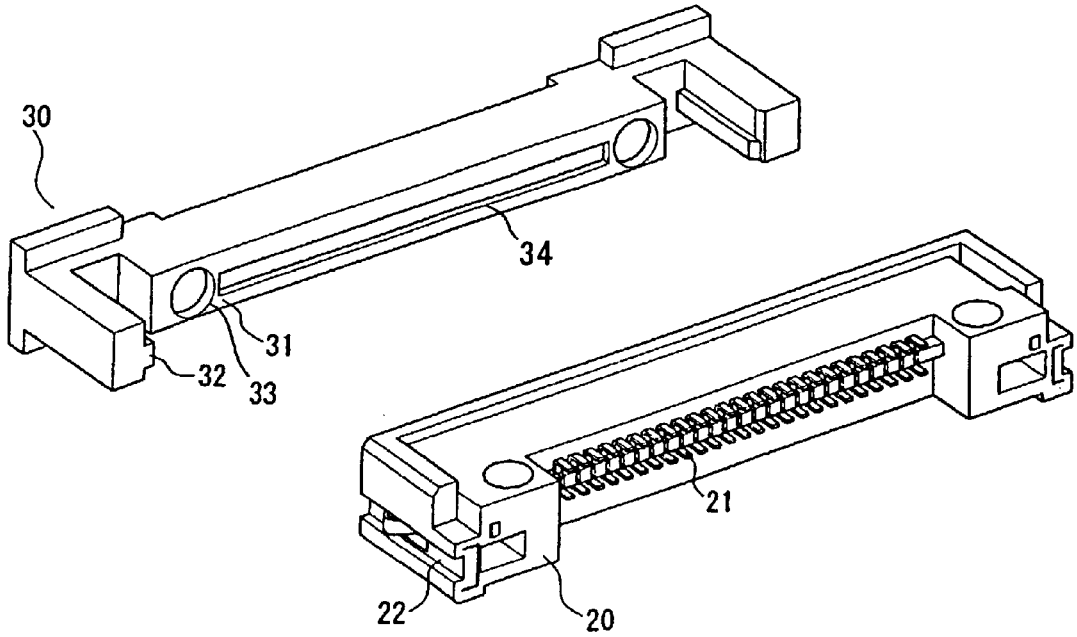
FIG. 2 is a rear perspective view of a connector with shutter according to the present invention together with a slot.
Figure 3:
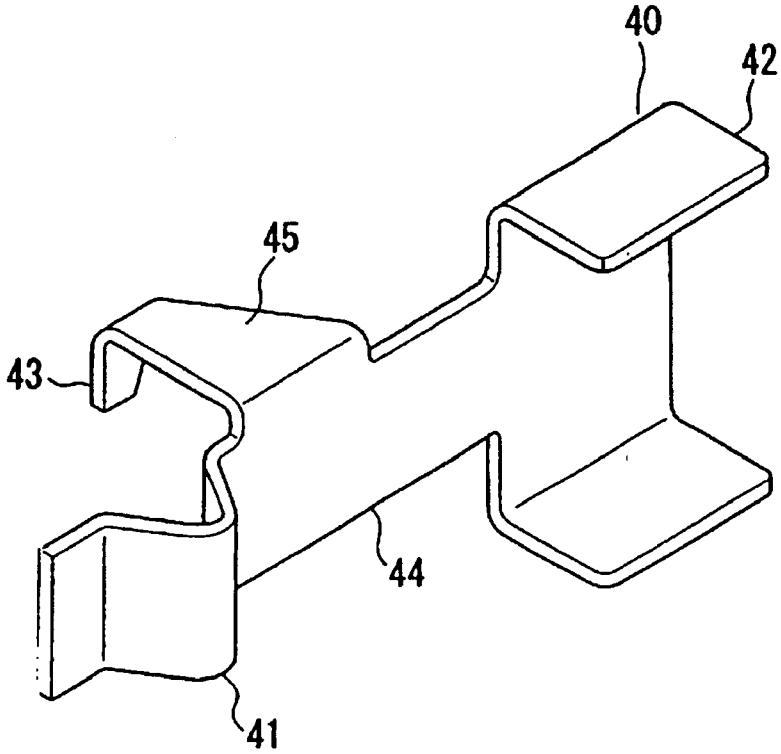
FIG. 3 is a perspective view of a stopper of a shutter used in a connector with shutter according to the present invention.
Figure 4:
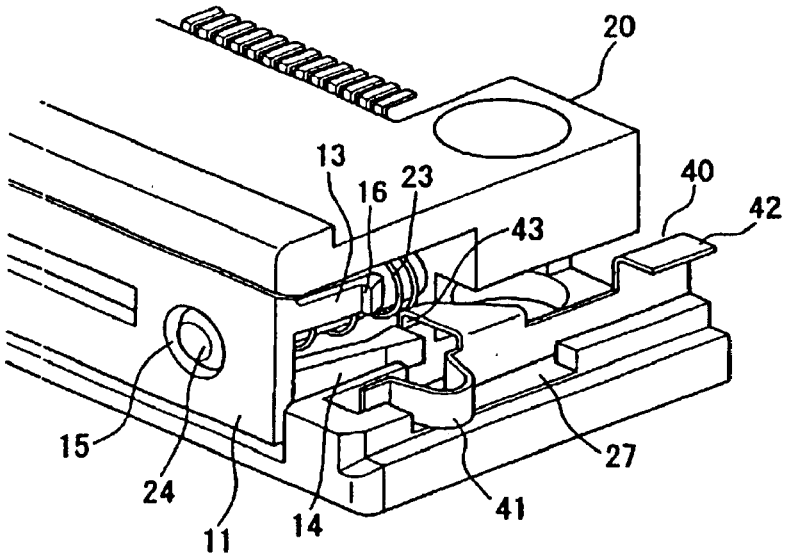
FIG. 4 is a partial cutaway view of a shutter detaining portion of a connector with shutter according to the present invention.
Figure 5:
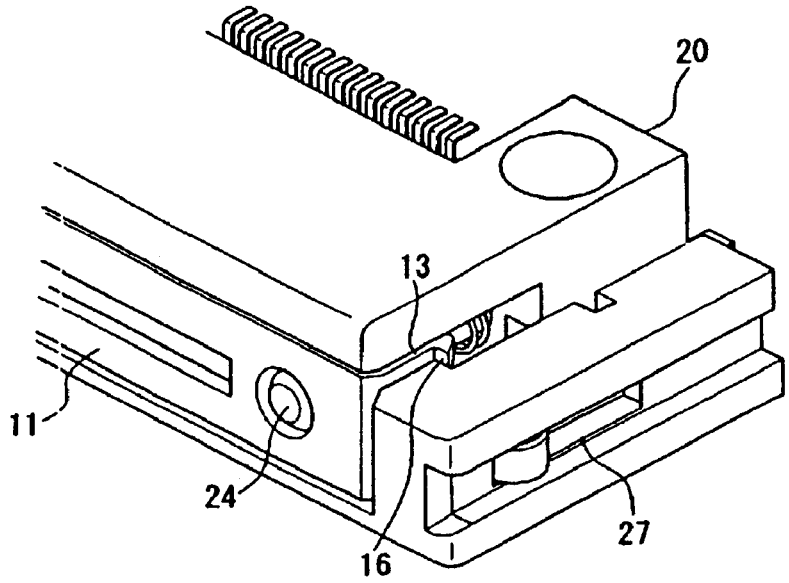
FIG. 5 is a partial cutaway view of a shutter with connector according to the present invention when the first detaining portion of the shutter is detained to the housing.
Figure 6:
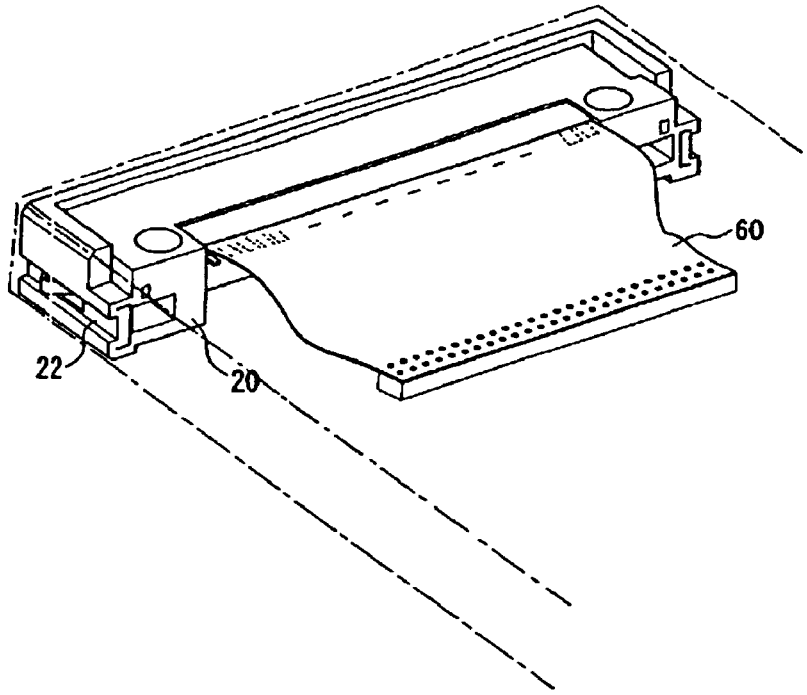
FIG. 6 is a perspective view of the connector connected to a flat cable as an example of application of the present invention.
Figure 7:
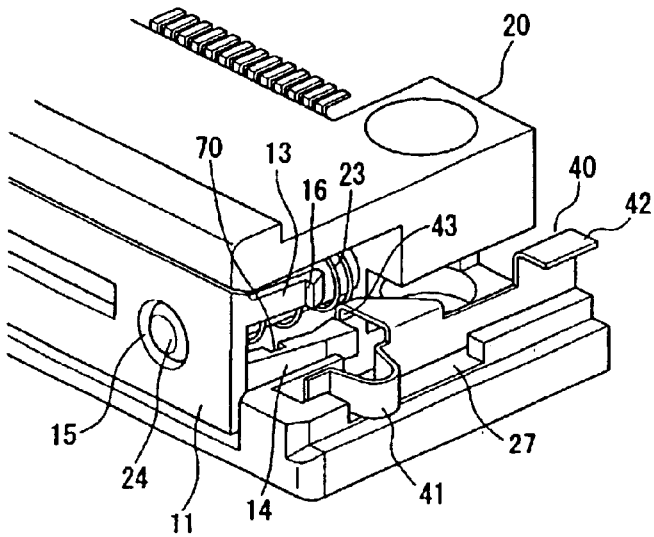
FIG. 7 is a perspective view showing a stopper release means formed along a slot in another embodiment of the present invention.
Figure 8:
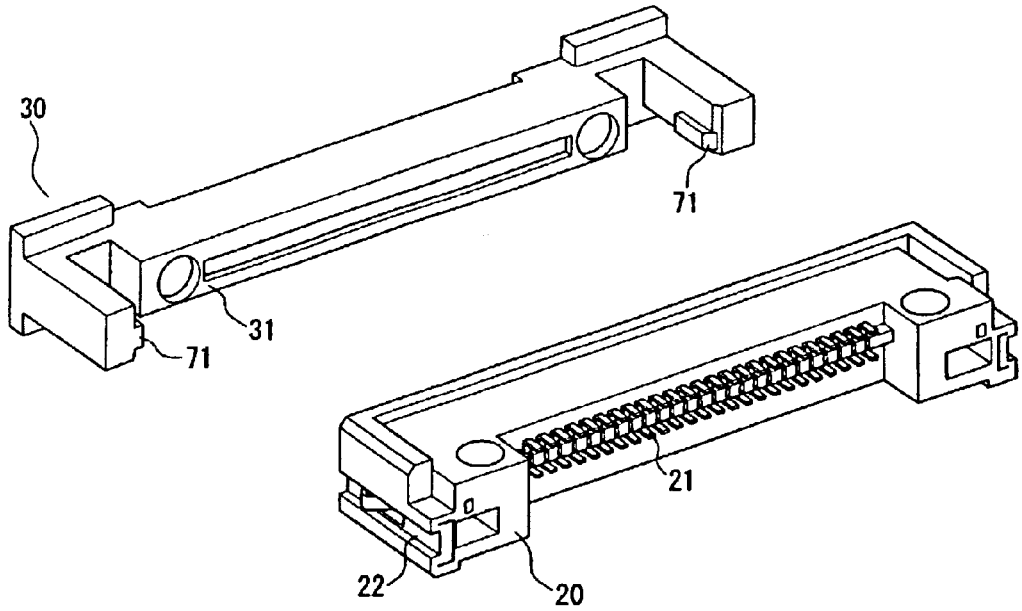
FIG. 8 is a partial cutaway view showing a notch in the second detaining portion of the shutter in another embodiment of the present invention.

11 shutter
12 aperture portion for passage of first contact portion
13 first detaining portion
14 second detaining portion
15 aperture for passage of guide device
16 claw of first detaining portion
20 housing
22 guide rail
23 spring for pressing shutter
24 guide device
25 first contact portion
26 aperture portion for insertion of second contact portion
27 aperture portion for projection of stopper
30 slot
31 face pressing against shutter
32 stopper release means
33 guide device insertion port
34 contact receiving portion
40 stopper
41 stopper release portion
42 stopper securing portion
43 shutter detaining portion
44 stopper securing portion
45 detaining portion support
60 flat cable
70 notch
71 stopper release means

What is claimed is:

1. A connector with a shutter for protecting a first contact portion of a peripheral device used in a computer, said connector comprising:

a housing having an aperture into which a second contact portion can be inserted;

a shutter capable of closing the aperture, and having a second detaining portion;

a spring for applying pressure to the shutter in the closed position; and a stopper having a stopper securing portion and a shutter detention portion for detaining and securing the shutter in the closed position by contacting the second detaining portion, wherein insertion of the second contact portion causes the shutter detention portion to move inward, allowing the second detaining portion to pass between the stopper securing portion and the shutter detention portion, thereby releasing the shutter, wherein the housing accommodates the shutter, spring and stopper, and the shutter includes a guiding device for guiding the shutter when the shutter slides in opposition to the pressure of the spring.

2. A connector as recited in claim 1, characterized in that when not plugged in, the pressure of said spring causes said shutter to close the aperture in the vicinity of the housing end surface, and said shutter is detained and secured by said stopper.

3. A connector as recited in claim 1, characterized in that when said connector is inserted into a slot, stopper release means provided in the slot push said stopper to release the detainment of said shutter, and when plugging in the connector, said shutter slides in opposition to the pressure of said spring so that a contact portion of said peripheral device passes through through holes in said shutter portion to fit with a contact receiving portion of the slot.

4. A connector as recited in claim 1, wherein the aperture is part of a front surface of the housing, such that when not plugged in, a front surface of the shutter facing the direction of insertion of the connector is recessed with respect to the front surface of the housing.

5. A connector as recited in claim 1, characterized in that when said connector is plugged in., said stopper operates as securing means for securing said shutter.

* * * * *